US007292695B2

(12) United States Patent
Kobayashi

(10) Patent No.: US 7,292,695 B2
(45) Date of Patent: Nov. 6, 2007

(54) BONE CONDUCTIVE SPEAKER

(75) Inventor: Kazuji Kobayashi, Suginami-ku (JP)

(73) Assignee: Temco Japan Co., Ltd., Tokyo (JP)

( * ) Notice: Subject to any disclaimer, the term of this patent is extended or adjusted under 35 U.S.C. 154(b) by 165 days.

(21) Appl. No.: 10/515,842

(22) PCT Filed: May 27, 2003

(86) PCT No.: PCT/JP03/06594

§ 371 (c)(1),
(2), (4) Date: Nov. 29, 2004

(87) PCT Pub. No.: WO03/101146

PCT Pub. Date: Dec. 4, 2003

(65) Prior Publication Data

US 2005/0254672 A1 Nov. 17, 2005

(30) Foreign Application Priority Data

May 28, 2002 (JP) ..... 2002-153245

(51) Int. Cl.
*H04R 25/00* (2006.01)

(52) U.S. Cl. ..... 381/151; 381/326

(58) Field of Classification Search ..... 381/151, 381/326, 380, 182, 162, 384, 386
See application file for complete search history.

(56) References Cited

U.S. PATENT DOCUMENTS

| | | | | |
|---|---|---|---|---|
| 2,062,372 | A * | 12/1936 | Nicholides | 381/151 |
| 2,127,468 | A * | 8/1938 | Henry | 381/151 |
| 2,463,786 | A * | 3/1949 | Lybarger | 381/417 |
| 6,141,427 | A * | 10/2000 | Fukuda | 381/151 |
| 6,668,065 | B2 * | 12/2003 | Lee et al. | 381/380 |
| 6,839,443 | B2 * | 1/2005 | Fukuda | 381/151 |
| 2001/0009586 | A1 * | 7/2001 | Suzuki | 381/151 |

* cited by examiner

*Primary Examiner*—Sinh Tran
*Assistant Examiner*—Joseph Saunders, Jr.
(74) *Attorney, Agent, or Firm*—Browdy and Neimark, PLLC

(57) ABSTRACT

A bone conductive speaker is downsized without causing any loss in efficiency, simple in construction low in cost, and comprises yoke (2), magnet (3) disposed in a central area of the yoke, and voice coil (4) wound on the magnet. The yoke has its peripheral area divided into a plurality of upright portions; of the upright portions, each of first ones (5) oppositely disposed from each other is provided with a first engaging means (9) in its upper surface; second engaging means (8) each corresponding to the first engaging means are provided in a vibrating plate (7). The vibrating plate is mounted on a lid portion of the housing in a manner such that the vibrating plate is disposed on the upright portions of the yoke and fixedly mounted by means of the second engaging means in a manner such that the vibrating plate floats in the housing.

5 Claims, 6 Drawing Sheets

PRIOR ART

BONE CONDUCTIVE SPEAKER

FIELD OF THE INVENTION

The present invention relates to a bone conductive speaker, and more particularly to a bone conductive speaker of a type adapted to be held in abutting contact with a head portion of a user for transmitting a vibration of a diaphragm or vibrating plate of the bone conductive speaker to a bone tissues of the head portion of the user, which makes it possible for the user to catch the sound.

BACKGROUND OF THE INVENTION

A conventional bone conductive speaker has a known construction such as one shown in FIGS. 4(A) and 4(B). Such bone conductive speaker is constructed of: a cylindrical casing 21 provided with a diaphragm or vibrating plate 22 in its upper surface; a magnet 23 mounted in the casing 21 in an insertion manner; a yoke 25, which is mounted in a lower portion of the casing in an insertion manner and provided with a center magnet pole 24 in its central area; and, a voice coil 26, with which the center magnet pole 24 of the yoke 25 is encircled.

This type of conventional bone conductive speaker has its components such as the center magnet pole 24, the voice coil 26, the magnet 23 and the casing 21 concentrically arranged radially outwardly in the order of mention in the above. Due to this, and since both the center magnet pole 24 and the voice coil 26 are encircled with both the magnet 23 and the casing 21, it is necessary to increase both the magnet 23 and the casing 21 in diameter in order to increase the center magnet pole 24 in diameter and increase the number of turns for the voice coil 26. This makes it inevitably necessary to increase the bone conductive speaker in outer diameter.

In order to improve the bone conductive speaker in output efficiency without causing such increase in its outer diameter, a second type of conventional bone conductive speaker such as one shown in Japanese Patent No. 2967777 has been already proposed, which one is shown in FIGS. 5(A) and 5(B) and has a construction in which: a yoke 31, which is disposed in a housing 30, and provided with a center magnet pole 32 encircled with a voice coil 33; a magnet 34, which is disposed in each of a pair of diametrically-opposing ones 37 of four extension portions 37, 38 of the yoke 31; a pair of upright diaphragm-support portions 36 each disposed in each of a pair of the remaining extension portions 38 of the yoke 31; and, a diaphragm or vibrating plate 35 fixedly mounted on these diaphragm support portions 36.

This second type of conventional bone conductive speaker is called the outer magnet type, in which the magnets 34 are disposed in an outer peripheral portion of the speaker. In this second type of bone conductive speaker, the magnets 34 and the diaphragm support portions 36 (which corresponds to the casing 21 of the first conventional bone conductive speaker) are disposed on the same circle in contrast with the first conventional bone conductive speaker in which the magnets 23 and the casing 21 are concentrically arranged so as to form a doubled-wall structure. Due to this, the second type of conventional bone conductive speaker may be reduced in its installation space by half of its ancestor or first type of conventional bone conductive speaker. This makes it possible for the second type of conventional bone conductive speaker to be improved in output efficiency by increasing its center magnet pole 32 in diameter and increasing the number or turns for its voice coil 33, without causing any increase of its outer diameter.

In recent years, much more downsizing is required of the bone conductive speaker with the widening of its applications, for example such as incorporation in a cellular phone and like applications. In the outer magnet type of conventional bone conductive speaker, however, since its magnet is disposed in the outer peripheral portion of the speaker, and also since it is difficult to produce the magnet of a slim or thin-thickness type having a sufficient physical strength at a low cost, it is necessary for the outer magnet type of bone conductive speaker to prevent its magnet from being too reduced in size. Due to this, it is not possible for the conventional bone conductive speaker to sufficiently meet the demand for much more downsizing of the speaker.

Further another type of conventional bone conductive speaker is shown in FIG. 6. This type of conventional bone conductive speaker is called the inner magnet type, wherein: disposed in a central area of a bowl-like yoke 42 is a magnet 41 which is encircled with a voice coil 43; the yoke 42 is received in a housing 44; and, a diaphragm or vibrating plate 45 is supported on an upper surface of the housing 44.

In this type of conventional bone conductive speaker, however, it is necessary for the housing 44 to have a sufficient diameter in order to support the vibrating plate 45 in a manner such that the vibrating plate 45 is easily vibrated in operation. This is because the vibrating plate 45 is supported on the upper surface of the housing 44. Consequently, also in this inner magnet type of bone conductive speaker, it is not possible to meet the demand for much more downsizing of the speaker.

As described above, any type of the conventional bone conductive speaker fails to meet the demand for much more downsizing of the speaker in incorporating the bone conductive speaker into a cellular phone. Under such circumstances, the present invention was made to meet the demand. Consequently, it is an object of the present invention to provide a bone conductive speaker, which is easily produced at a low cost to meet the demand.

SUMMARY OF THE INVENTION

The above object of the present invention is achieved by providing: a bone conductive speaker comprising a yoke (2), a magnet (3) disposed in a central area of the yoke, and a voice coil (4) wound on the magnet (3), wherein: the yoke (2) has its peripheral area divided into a plurality of upright portions; of the upright portions, each of a pair of first ones (5) oppositely disposed from each other is provided with a first engaging means (9) in its upper surface; a pair of second engaging means (8) each corresponding to the first engaging means (9) are provided in a vibrating plate (7); the vibrating plate (7) is mounted on a lid portion of the housing in a manner such that the vibrating plate (7) is disposed on the upright portions of the yoke and fixedly mounted by means of the second engaging means in a manner such that the vibrating plate floats in the housing.

In the bone conductive speaker having the above construction, preferably: each of the first engaging means provided in the upper surface of the upright portions is constructed of an engaging projection; each of the second engaging means provided in the vibrating plate is constructed of a notch portion of the vibrating plate; and, the first engaging projection of the yoke is engaged with the notch portion of the vibrating plate.

BEST MODE FOR CARRYING OUT THE INVENTION

Figure 1:
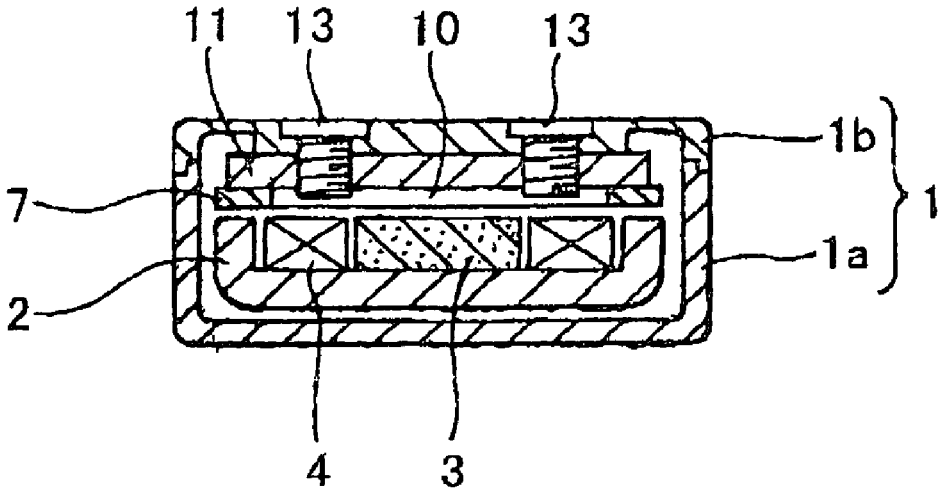
FIG. 1 is a longitudinal sectional view of the bone conductive speaker of the present invention, illustrating the entire construction of the speaker.
Figure 2:
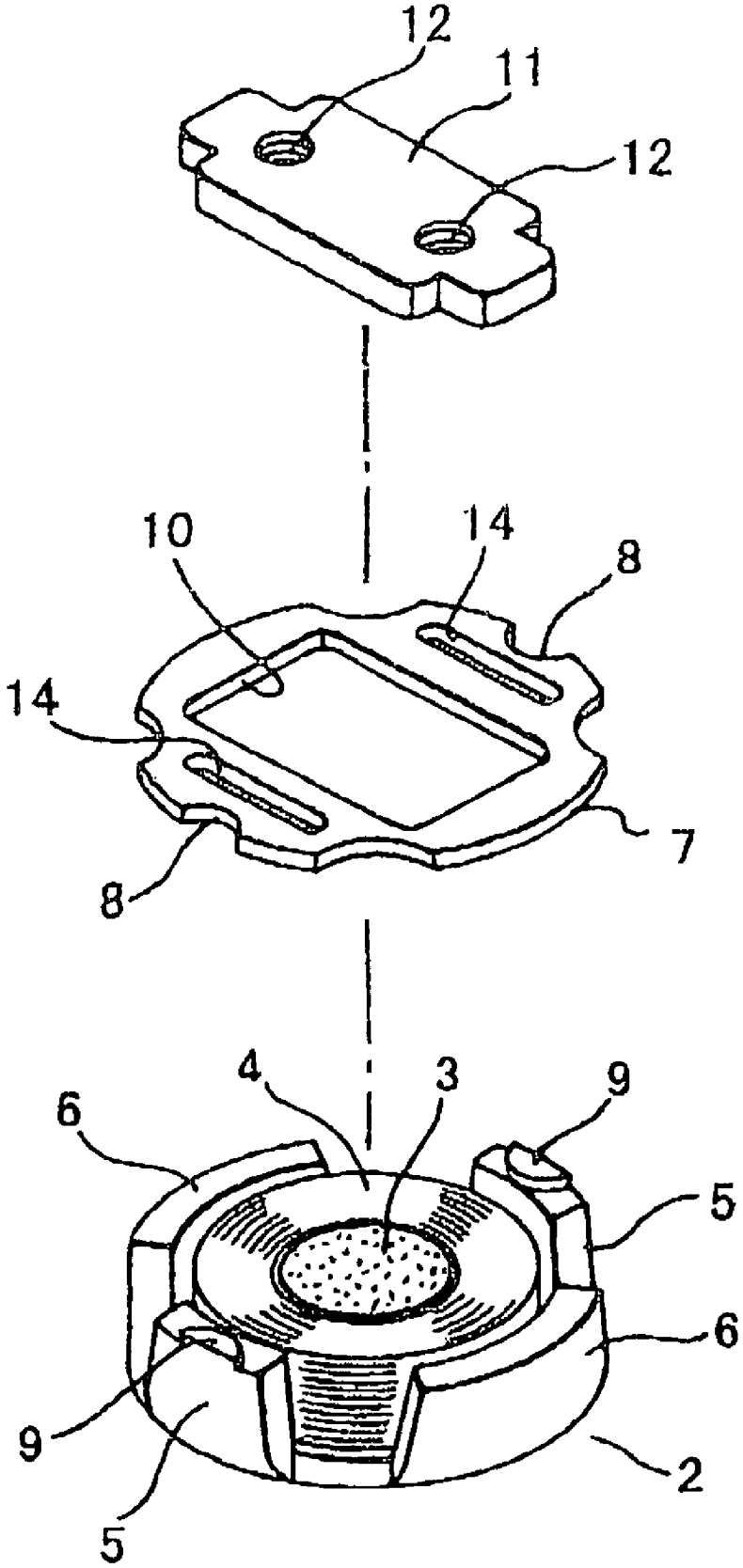
FIG. 2 is an exploded perspective view of the bone conductive speaker of the present invention, illustrating both a vibrating portion and a drive portion of the speaker.
Figure 3:
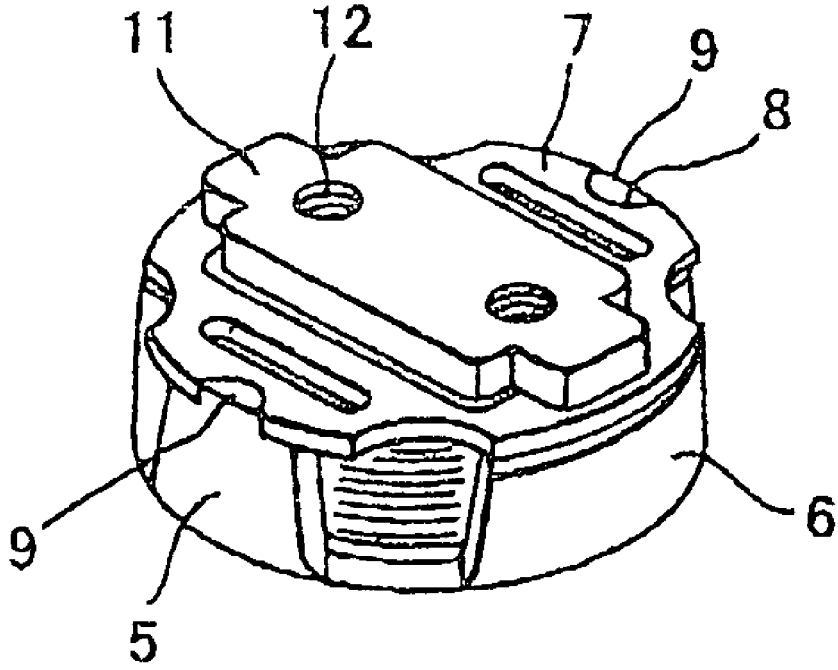
FIG. 3 is a perspective view of an assembly, wherein the assembly is assembled from both the vibrating portion and the drive portion of the bone conductive speaker of the present invention.
Figure 4A:
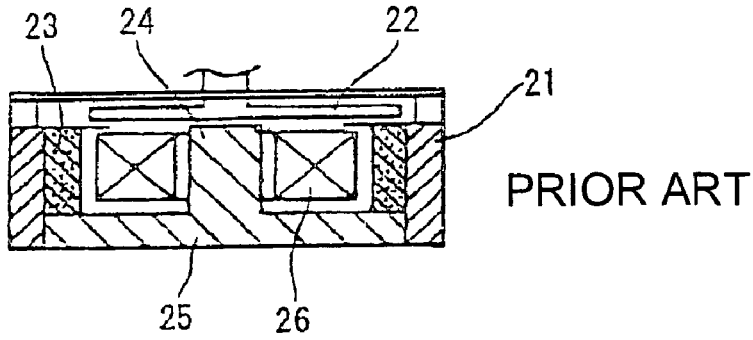
FIGS. 4(A) and 4(B) show a conventional type of bone conductive speaker in construction.
Figure 4B:
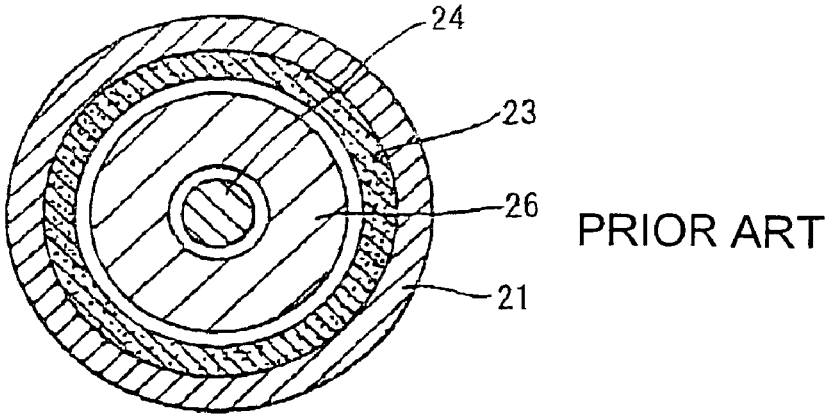
Figure 5A:
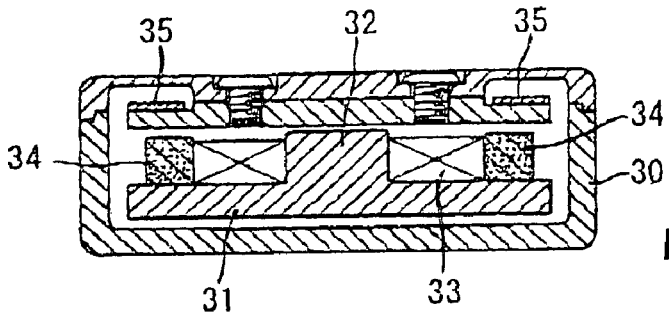
FIGS. 5(A) and 5(B) show another type of conventional bone conductive speaker.
Figure 5B:
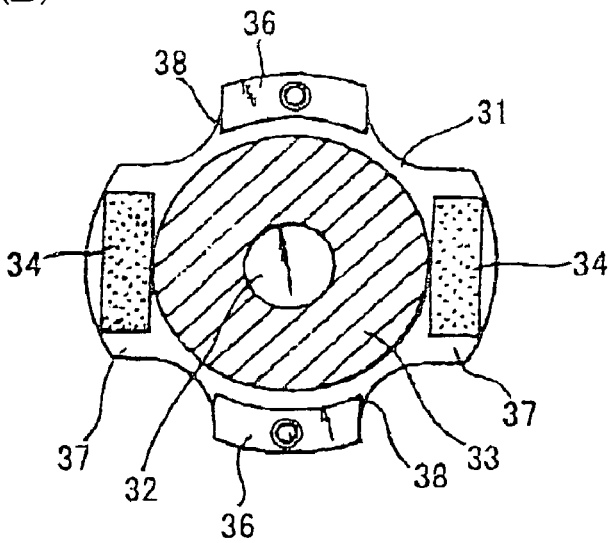
PRIOR ART FIG. 5(B)
Figure 6:
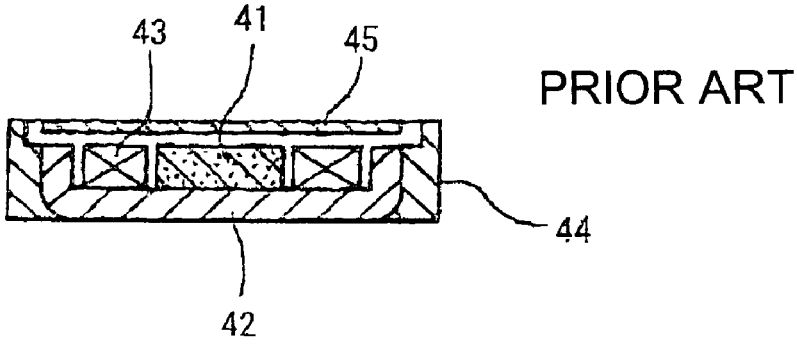
FIG. 6 shows still another type of conventional bone conductive speaker.

With reference to the accompanying drawings, embodiments of the present invention will be described. FIG. 1 is a longitudinal sectional view of the bone conductive speaker of the present invention, illustrating the entire construction of the speaker comprising a housing 1. FIG. 2 is an exploded perspective view of the bone conductive speaker of the present invention, illustrating a vibrating portion and a drive portion of the speaker both received in the housing 1. FIG. 3 is a perspective view of an assembly, wherein the assembly is assembled from both the vibrating portion and the drive portion of the bone conductive speaker of the present invention.

As shown in FIG. 1, the housing 1 is divided into: an upper portion which is formed into a lid portion 1*b*; and, a lower portion which is formed into a container portion 1*a* in which the drive portion is received in a floating manner. The lid portion 1*b* of the housing 1 is fixedly mounted on the drive portion thereof.

This drive portion of the housing 1 is constructed of: a bowl-like yoke 2; a magnet 3 disposed in a central area of the yoke 2; and, a voice coil 4, with which the magnet 3 is encircled. The peripheral wall portion of the yoke 2 is divided into a plurality of upright portions (four upright portions in an example shown in the drawings). Of these upright portions, each of a pair of ones 5, 5 oppositely disposed from each other is formed into a diaphragm support for supporting a diaphragm or vibrating plate 7. The remaining ones 6, 6 of the upright portions of the yoke 2 thus divided are oppositely disposed from each other to become components of a magnetic circuit.

Provided in an upper surface of each of the upright portions 5, 5 for receiving the vibrating plate 7 is a first engaging projection 9. This engaging projection 9 is engaged with each of second engaging means such as notch portions 8, 8 in an insertion manner, wherein the notch portions 8, 8 are formed in opposite end portions of the vibrating plate 7. Due to the above construction, it is possible for the vibrating plate 7 to have its notch portions 8, 8 engaged with the first engaging projections 9, 9 of the yoke 2 in an insertion manner from upside as viewed in FIG. 2. This makes it possible to fixedly mount and position the vibrating plate 7 on the yoke 2, without requiring any additional space for welded or adhered portions of the vibrating plate 7. Consequently, the bone conductive speaker of the present invention is capable of being sufficiently downsized.

The vibrating plate 7 assumes a circular shape provided with four engaging projections and four concave portions. Of these four engaging projections, each of a pair of engaging projections oppositely disposed from each other is provided with the notch portion 8 in its free end portion On the other hand, a large-sized rectangular central opening 10 is formed in a central area of the vibrating plate 7.

The reference numeral 11 denotes a plate yoke. The plate yoke 11 extends along the central opening 10 of the vibrating plate 7, and has its opposite end portions mounted on the remaining ones of the above-mentioned four engaging projections of the vibrating plate 7, which remaining ones are not provided with any notch portion. These opposite end portions of the plate yoke 11 are fixedly mounted on the remaining ones of the engaging projections of the vibrating plate 7 through a welding process, an adhering process or like fastening means. Due to this, the drive portion and the vibrating portion of the bone conduction speaker are assembled into an assembly, wherein: the drive portion of the speaker comprises the yoke 2, magnet 3 and the voice coil 4; and, the vibrating portion of the speaker comprises the vibrating plate 7 and the plate yoke 11 (see FIG. 3).

In general, a pair of threaded holes 12, 12 are formed in the plate yoke 11. Each of The threaded holes 12, 12 of the plate yoke 11 is threadably engaged with each of set screws 13, 13 which have passed through the corresponding through-holes of a lid portion 1*b* of the housing 1. As a result, the assembly assembled from both the vibrating portion and the drive portion of the speaker is incorporated in the housing 1 in a manner such that the assembly is suspended from the lid portion 1*b* so as to float above the inner bottom surface of the container portion 1*a* of the housing 1 (see FIG. 1). Incidentally, although not shown in the drawings, a suitable signal input line is arranged in the housing 1.

In the bone conductive speaker of the present invention having the above construction, when the drive portion of the speaker receives a sound or audio input signal, the vibrating portion of the bone conduction speaker begins to vibrate. Such vibration of the vibrating portion of the speaker is effectively transmitted to the housing 1. This makes it possible to realize a bone conductive speaker excellent in output efficiency.

The above-mentioned embodiment of the present invention is a simple one of various examples. Due to this, it is natural that the present invention is not limited to this example. For example, it is also possible for the present invention to provide an appropriate lightening hole 14 in the vibrating plate 7 in order to reduce the vibrating plate in weight. Further, it is also possible for the present invention to fixedly mount the plate yoke 11 on the lid portion 1*b* of the housing 1 by means of a single set screw 13. Still further, it is also possible for the present invention to modify each of the notch portions 8 and the engaging projections 9 into any desired shape.

In place of the provisions of both the notch portion 8 and the engaging projection 9, it is also possible to employ a convex portion formed in a rear surface of the vibrating plate 7 together with a concave portion formed in the upper surface of each of the upright portions 5, 5 of the yoke 2, which concave portion corresponds in position to the convex portion of the vibrating plate 7 and is fixedly engaged with the convex portion of the vibrating plate 7 in an insertion manner.

INDUSTRIAL APPLICABILITY

The present invention has a construction as described above. In the bone conductive speaker of the present invention: both the upper surfaces of the peripheral upright portions of the yoke and the vibrating plate of the speaker are provided with their engaging means, through which means the vibrating plate is fixedly mounted on the upright portions of the yoke. Further, in the bone conductive speaker of the present invention, since the magnet is disposed in the central area of the yoke, it is possible to reduce the upright portions of the yoke in thickness. This makes it possible to reduce the bone conductive speaker of the present invention in diameter as a whole, which makes it possible to sufficiently meet the demand for incorporating the bone conductive speaker of the present invention into a cellular phone or like units. Further, in the bone conductive speaker of the present invention, it is also possible to increase the number of turns for the voice coil without any loss of output efficiency. Still further, it is also possible to realize the bone conductive speaker of the present invention at a low cost in an easy manner. These are advantages and effects inherent in the present invention.

The invention claimed is:

1. A bone conductive speaker comprising a yoke (2), a magnet (3) disposed in a central area of said yoke, and a voice coil (4) wound on, and encircling, said magnet (3), wherein: said yoke (2) has its peripheral area divided into a plurality of upright portions; of said upright portions, each of a pair of first ones (5) oppositely disposed from each other is provided with a first engaging means in its upper surface; a pair of second engaging means each corresponding to said first engaging means are provided in a vibrating plate (7); said vibrating plate (7) is mounted on a lid portion (1*b*) of a housing (1) in a manner such that said vibrating plate (7) is disposed on said upright portions of said yoke (2) and fixedly mounted by means of said second engaging means in a manner such that said vibrating plate (7) floats in said housing (1), and further wherein: said first engaging means provided in said upper surface or said upright portion of said yoke is constructed of a concave portion or a convex portion; and, said second engaging means provided in said vibrating plate is constructed of a convex portion or a concave portion, which said convex portion or said concave portion of said vibrating plate correspond to said concave portion or said convex portion of said first engaging means of said yoke, respectively.

2. A bone conductive speaker comprising a yoke (2), a magnet (3) disposed in a central area of said yoke, and a voice coil (4) wound on, and encircling, said magnet (3), wherein: said yoke (2) has its peripheral area divided into a plurality of upright portions; of said upright portions, each of a pair of first ones (5) oppositely disposed from each other is provided with a first engaging means in its upper surface; a pair or second engaging means each corresponding to said first engaging means are provided in a vibrating plate (7); said vibrating plate (7) is mounted on a lid portion (1*b*) of a housing (1) in a manner such that said vibrating plate (7) is disposed on said upright portions of sam yoke (2) and fixedly mounted by means of said second engaging means in a manner such that said vibrating plate (7) floats in said housing (1), and further wherein: each of said first engaging means provided in said upper surface of said upright portions is constructed of an engaging projection (9) integral with a respective one of said pair of first ones of said upright portions; each of said second engaging means provided in said vibrating plate is constructed of a notch portion (8) of said vibrating plate; and, said first engaging projection of said yoke is engaged with said notch portion of said vibrating plate.

3. The bone conductive speaker as set forth in claim 1, wherein: said yoke assumes a circular shape; and, each of said upright portions of said yoke assumes a circularly-curved shape in cross section.

4. The bone conductive speaker as set forth in claim 1, wherein: said vibrating plate is provided with a central opening; and, a plate yoke is fixedly mounted on said vibrating plate in a manner such that said plate yoke straddles said central opening of said vibrating plate.

5. The bone conductive speaker as set forth in any one of claims 1, 2, 3 and 4, wherein said vibrating plate is provided with a lightening hole portion in order to reduce its weight.

* * * * *